US006056174A

United States Patent [19]

Minckler

[11] Patent Number: 6,056,174

[45] Date of Patent: May 2, 2000

[54] COMPACT DISC PLAYER HOLSTER

[76] Inventor: Andrew R Minckler, P.O. Box 156, Ellenburg Depot, N.Y. 12935

[21] Appl. No.: 09/136,152

[22] Filed: Aug. 18, 1998

[51] Int. Cl.[7] ..... A45F 3/14

[52] U.S. Cl. ..... 224/250; 224/674; 224/901.4; 224/901.8; 224/930; 150/154

[58] Field of Search ..... 224/930, 250, 224/674, 675, 901.4, 901.8; 150/162, 154; D3/228, 229, 218, 204, 221, 224

[56] References Cited

U.S. PATENT DOCUMENTS

| | | | |
|---|---|---|---|
| D. 407,896 | 4/1999 | Y'shua et al. | D3/228 |
| 4,057,757 | 11/1977 | Darden, Jr. | 224/901.4 |
| 5,439,153 | 8/1995 | Murdoch et al. | 224/153 |
| 5,806,730 | 9/1998 | Deno | 224/250 |

*Primary Examiner*—Linda J. Sholl
*Attorney, Agent, or Firm*—Michael I. Kroll

[57] ABSTRACT

The present invention 10 discloses an apparatus whereby whereby an individual 12 is able to conveniently carry a compact disc player 14 within the holster 16 of the present invention made from strap material which forms the various sides and layers of the present invention 10. Disclosed is a length of hook and loop material 18 attached to the ends of the frontal closure straps 20 of the compact disc player carrying case 10 and the compact disc player carrying case having securing means in the form of a loop 22 wherein the compact disc player carrying case can be attached to a belt 24 located around the waist of an individual. The strap 26 forms the bottom of the holster 16 and is attached to the loop 22 for being secured to a belt 24. Additional embodiments provide a compartment 40 within which additional compact discs 42 are stored and also a hood 44 is provided to protect the compact disc player 14 from the weather.

6 Claims, 11 Drawing Sheets

COMPACT DISC PLAYER HOLSTER

BACKGROUND OF THE INVENTION

1. Field of the Invention

The present invention relates generally to carrying cases and, more specifically, to a carrying case for a compact disc player, the carrying case being constructed of a plurality of straps sewn in such a manner as to form a cavity wherein the compact disc player is inserted and a pair of frontal closure straps having a length of hook and loop material on their ends are attached to each other by overlapping the ends thereby securing the compact disc player within the cavity. Additionally, straps are sewn to form a loop wherein a belt may be inserted providing means for the compact disc player carrying case to be worn around the waist. An additional embodiment is provided having a compartment within the cavity for storage of additional compact discs or similar items.

Apparatus for carrying a cassette tape player and a plurality of cassette tapes on the body of a person includes a belt which is secured about the body of the person; a tape player holder which holds a cassette tape player; three male snap elements in a triangular configuration mounted on the belt and three female snap elements mounted on the tape player holder for engagement with the male snap elements to secure the tape player holder on the belt at the left or right hip area; a plurality of cassette tape holders, each adapted to hold a cassette tape; a plurality of pairs of vertically spaced male snap elements mounted on the belt and two vertically spaced female snap elements mounted on each cassette tape holder for engagement with selected ones of the male snap elements to releasably secure each cassette tape holder at a selected one of a plurality of different positions on the belt. The tape player holder can take one of three different forms.

A pocket calculator holder for selectively detachably securing the holder to a waist belt of a user or to a shoulder strap provides for the use of a holder body having a closed bottom, closed sides and an open top. The holder body is secured to the shoulder strap or to a wearer's belt through the use of a pair of spaced apart strips attached to the back portion of the holder body. One of the ends of the strips is securely attached to the back portion of the holder body, while the second end is provided with a fastener element to fasten with a co-aligned mating fastener element attached to the back portion of the holder body. The second embodiment provides for the use of a pair of spaced apart strips mounted on an underside of a flap which is securely attached to a back portion of the holder body. The strips on the underside of the flap form loops with the underside of the flap for receiving a shoulder strap therein. A waist belt securing means of the second embodiment provide for the use of a pair of spaced apart strips securedly attached at least at one of their ends to the back portion of the holder body.

A modular system of interchangeable compartments mounted on a support member. The support member, such as a belt or vest, includes a support surface portion formed of a continuously looped, brushed polyester weave material. The outer surface is smooth and will not accidentally snag other surfaces. Compartment modules, provided in a variety of shapes and sizes according to the activity in which the modular system is to be used, include at least one fastening strip of upstanding hook elements. The upstanding hook elements are able to engage the continuously looped brushed polyester weave to secure the compartment modules onto the support surface portion of the modular system. The compartment modules can be attached to the support surface in any desired position as well as any angular orientation by simply pressing the fastening strips onto the support surface. The compartment modules are easily removed from the support surface. Thus, the modular system can be easily reconfigured as necessary for a variety of activities.

A multi-purpose portable carrier having side-by-side compartments for the storing of portable electronic and/or photographic equipment. Successive compartments are fastened together by zipper fasteners so that the side-by-side compartments can be aligned linearly or along an arcuate path or an endless path. An intermediate compartment has a front panel that is extended away from the rear panel so as to expose the front of portable equipment stored in the intermediate compartment. The intermediate compartment has opened sides and an optionally open top. Fasteners on the inner wall of the rear panel and the rear wall of the portable equipment stored in the intermediate compartment prevent the portable equipment from accidentally falling out of the intermediate compartment.

A camera holder is described in which the various panels are formed contiguously from a unitary piece of flexible material. A top cover extends over the top of the holster and a flap foldably extends downwardly from the top cover and releasably attaches to the front panel. Loop means are provided at the back panel for supporting the camera holster on a belt.

While these carrying cases may be suitable for the purposes for which they were designed, they would not be as suitable for the purposes of the present invention, as hereinafter described.

SUMMARY OF THE PRESENT INVENTION

The present invention describes an apparatus whereby an individual is able to conveniently carry a compact disc player within the holster of the present invention made from strap material which forms the various sides and layers of the present invention. Disclosed is a length of hook and loop material attached to the ends of the frontal closure straps of the compact disc player carrying case and the compact disc player carrying case having securing means in the form of a loop wherein the compact disc player carrying case can be attached to a belt located around the waist of an individual. A strap forms the bottom of the holster and is attached to the loop for being secured to a belt. Additional embodiments provide a compartment within which additional compact discs are stored and also a hood is provided to protect the compact disc player from the weather.

A primary object of the present invention is to provide a carrying case for a compact disc player.

Another object of the present invention is to provide a carrying case for a compact disc player wherein the structure of said carrying case does not impede access to the buttons and switches of the compact disc player and allows for discs to be changed without removal from carrying case.

Yet another object of the present invention is to provide a carrying case for a compact disc player with securing means whereby an individual can hang said carrying case from their person, such as, from a belt around the waist.

Still yet another object of the present invention is to provide a carrying case for a compact disc player or for carrying additional discs in a hard plastic compact disc holder.

Another object of the present invention is to provide an additional embodiment wherein said carrying case having a compartment whereby additional discs can be stored.

Additional objects of the present invention will appear as the description proceeds.

The present invention overcomes the shortcomings of the prior art by providing a carrying case for a compact disc player made from a strap material such as canvas which does not hinder the use of the functions of the compact disc player and provides means for attaching said carrying case to a belt which enhances the portability of said compact disc player and an additional embodiment which provides a compartment for storage of additional discs or other such items.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT(S)

Figure 1:
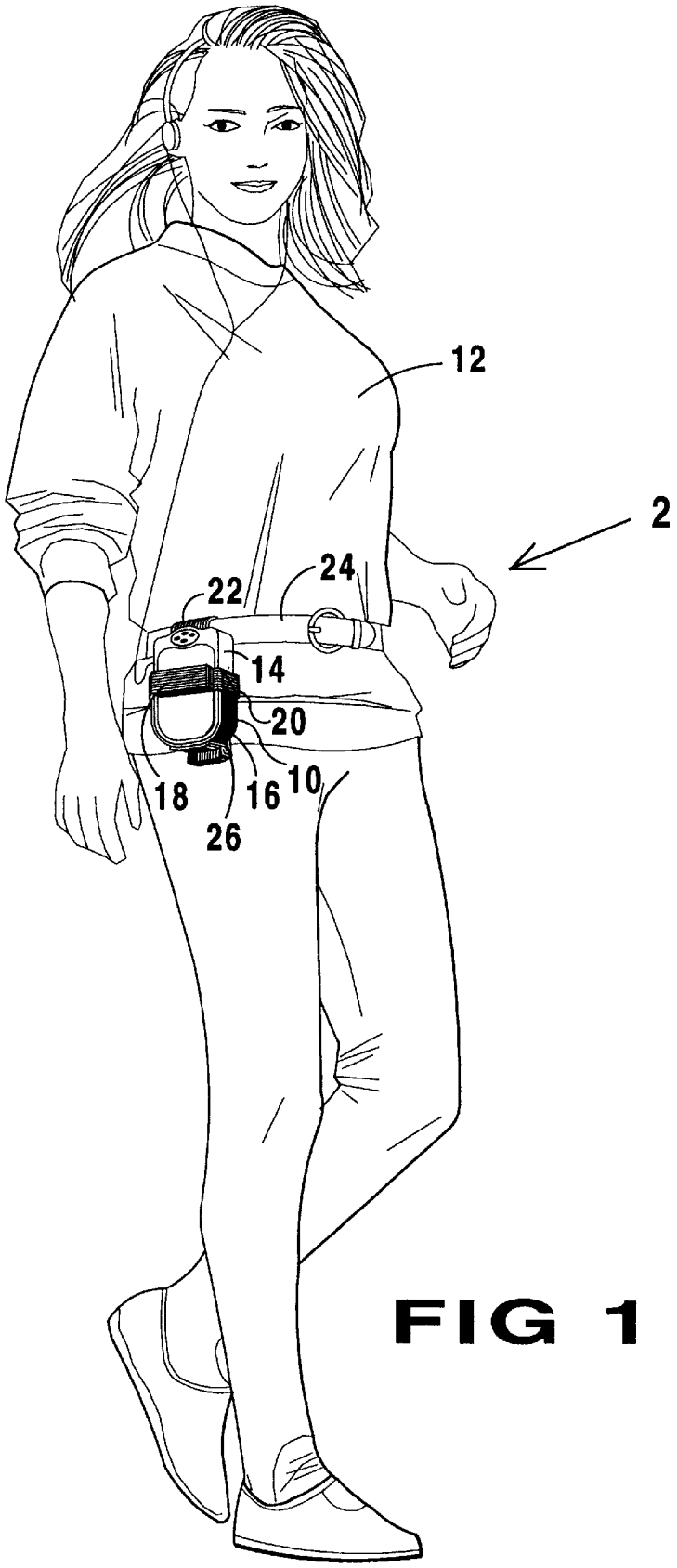
FIG. 1 is a perspective view of the present invention in use whereby an individual is able to conveniently carry a compact disc player within a holster made from a strap material with a length of hook and loop material attached to the ends of the frontal closure straps of the compact disc player carrying case and said compact disc player carrying case having securing means in the form of a loop wherein said compact disc player carrying case can be attached to a belt located around the waist of an individual.

Turning now descriptively to the drawings in which similar reference characters denote similar elements throughout the several views, FIGS. 1 through 11 illustrate the present invention being a device 10 for holding a compact disc player 14. With regard to the reference numerals used, the following numbering is used throughout the various drawings.

10 present invention
12 user
14 compact disc player
16 holster
18 hook and loop material of front strap
20 front closure strap
22 belt loop
24 belt
26 bottom strap
28 cavity of holster
30 sewing attachment
31 CD bottom hook and loop material
32 bottom of CD player
33 CD bottom hook and loop mating material
34 sewing attachment
36 compact disc
40 CD storage compartment
42 CD discs
44 plastic hood
46 elastomeric member
48 attachment means
50 attachment means Turning to FIG. 1, therein is shown a perspective view of the present invention generally shown at 10 and shown in operative connection and use whereby an individual 12 is able to conveniently carry a compact disc player 14 or other electronic device within the holster 16 of the present invention made from strap material which forms the various sides and layers of the present invention 10. Shown is a length of hook and loop material 18 attached to the ends of the frontal closure straps 20 of the compact disc player carrying case 10 and the compact disc player carrying case having securing means in the form of a loop 22 wherein the compact disc player carrying case can be attached to a belt 24 located around the waist of an individual. The strap 26 forms the bottom of the holster 16 and is attached to the loop 22 for being secured to a belt 24. Note that the present invention 10 does not impede access to the buttons and control switches of the electronic device 14 and allows for discs to be changed without removal of the device from the case 10.

Figure 2:
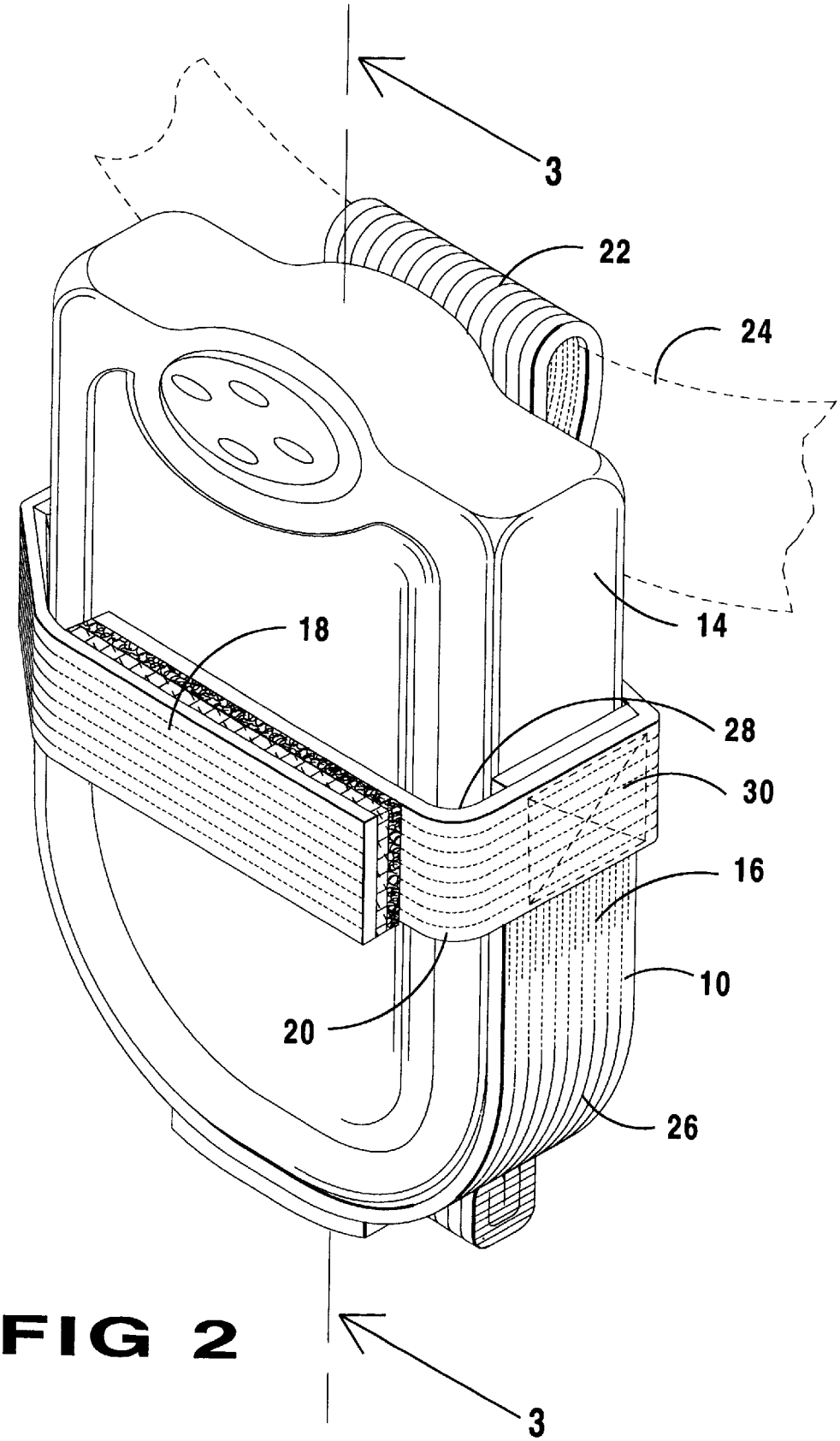
FIG. 2 is an enlarged view of the compact disc player carrying case, taken from FIG. 1 as indicated. Shown is a compact disc player enclosed within a cavity formed by sowing the strap material and said compact disc player being adjustably secured within said cavity by frontal closure straps having an amount of hook and loop material attached to the ends thereof. Also shown is a loop formed by sewing overlapping strap material thereby providing means for attaching said compact disc player carrying case to a belt located around the waist of an individual.

Turning to FIG. 2, therein is shown an enlarged view of the compact disc player carrying case 10, taken from FIG. 1 as indicated. Shown is a compact disc player 14 enclosed within a generally upright cavity or holster 28 formed by sewing the strap material 30 together. The compact disc player 14 being adjustably secured within the cavity 28 by a first strap, the frontal closure straps 20, having releasable connecting means being an amount of hook and loop material 18 attached to the ends thereof and having the ends overlap each other. The second strap 26 forms the bottom of the holster 16 and is sewn and attached to the frontal closure straps 20 at 30. Also shown is a loop 22 formed by sewing a third overlapping strap material thereby providing means for attaching the compact disc player carrying case 10 to a belt 24 located around the waist of an individual.

Figure 3:
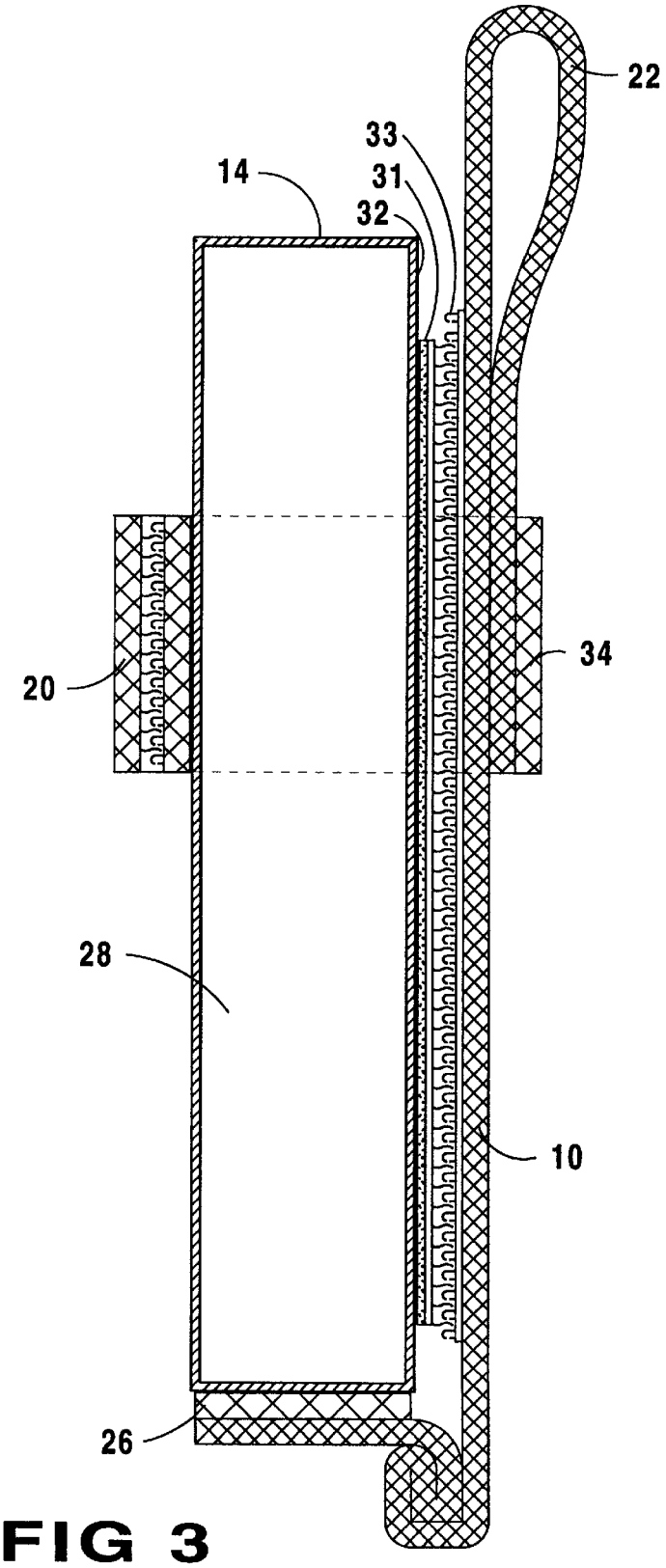
FIG. 3 is a cross sectional view, taken from FIG. 2 as indicated, showing the compact disc player enclosed within the cavity formed by the straps. Also shown is a length of hook and loop material which is attached to one side of the compact disc player whereby the compact disc player is attached to the compact disc player carrying case wherein the frontal straps can be opened to change the playing disc without removing said compact disc player from the compact disc player carrying case.

Turning to FIG. 3, therein is shown a cross sectional view, taken from FIG. 2 as indicated, showing the compact disc player 14 enclosed within the cavity 28 formed by the straps. Also shown is a length of hook and loop material 31 which is attached to one side being the back or bottom side 32 of the compact disc player 14 whereby the compact disc player 14 is attached to the compact disc player carrying case 10 by mating to other hook and loop material 31 located on the inside of the holster 14 on the inner face of the belt loop strap 22, wherein the frontal straps 20 can be opened to change the playing disc without removing said compact disc player 14 from the compact disc player carrying case 10. Also shown is the belt loop 22 of the carrying case 10 and the strap 26 which forms the bottom of the carrying case 10 or holster which is attached by sewing to the strap forming the belt loop 22 near the bottom. Shown also is the front closure strap 20 attaching by sewing to the belt loop 22 at 34.

Figure 4:
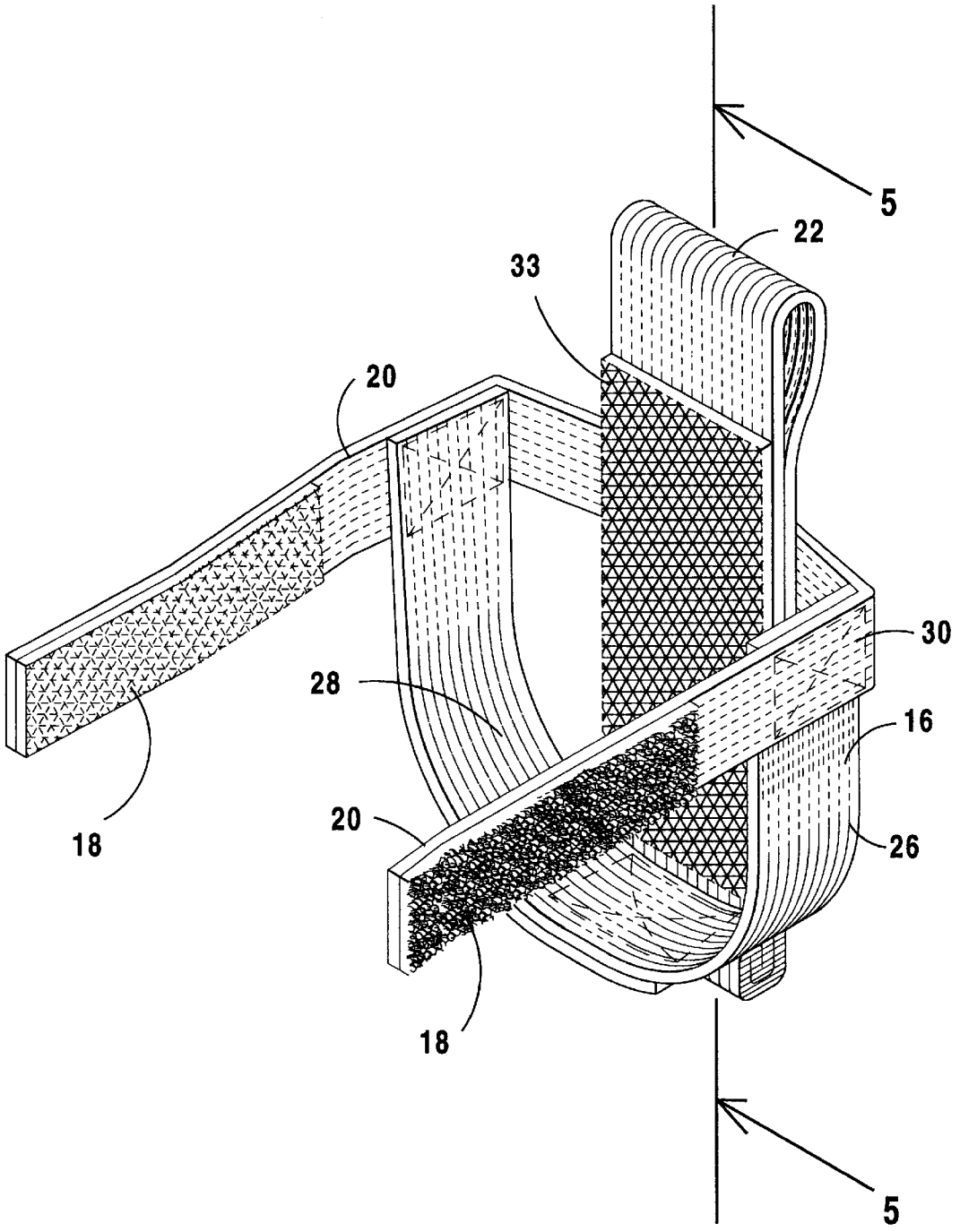
FIG. 4 is a perspective view of the present invention. Shown is the strap material of the compact disc player carrying case having an amount of hook and loop material attached to the ends of the frontal straps thereby providing an adjustable means for closure. Also shown is a loop formed by overlapping the strap material thereby providing means for attaching said compact disc player carrying case to a belt.

Turning to FIG. 4, therein is shown a perspective view of the present invention. Shown is the strap material of the compact disc player carrying case having an amount of hook and loop material 18 attached to the ends of the frontal straps 20 thereby providing an adjustable means for closure which is constructed and operates in generally the horizontal plane of the present invention 10. Also shown is a loop 22 formed by overlapping the strap material thereby providing means for attaching said compact disc player carrying case 10 to a belt. Also shown is a cavity 28 formed by sewing the strap material together. The compact disc player (not shown) being adjustably secured within the cavity 28 by frontal closure straps 20 having an amount of hook and loop material 18 attached to the ends thereof and having the ends overlap each other. Also shown is a loop 22 which is constructed generally in the vertical plane of the present invention 10 formed by sewing overlapping strap material thereby providing means for attaching the compact disc player carrying case 10 to a belt 24 located around the waist of an individual. The strap 26 which is constructed generally in the vertical plane of the present invention 10 forms the bottom of the holster 16 and is sewn and attached to the frontal closure straps 20 at 30. Also shown is the mating material 33 for the hook and loop material 31 located on the bottom of the CD player (not shown).

Figure 5:
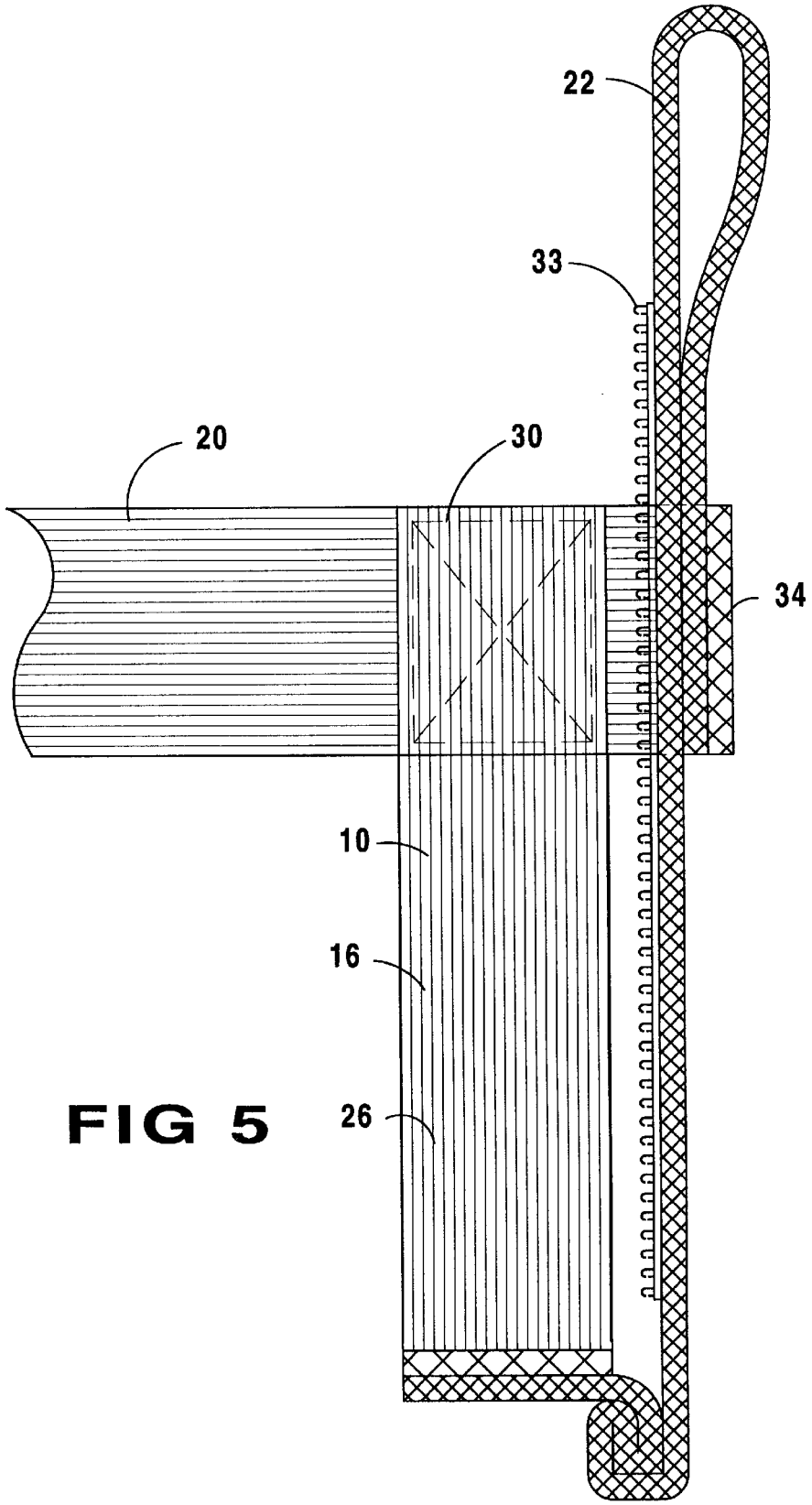
FIG. 5 is a cross section of the present invention, taken from FIG. 4 as indicated. Shown is the strap material of the compact disc player carrying case.

Turning to FIG. 5, therein is shown a cross section of the present invention, taken from FIG. 4 as indicated. Shown is the strap material of the compact disc player case 10 and the frontal closure straps 20. Also shown is a loop 22 formed by sewing overlapping strap material thereby providing means for attaching the compact disc player carrying case 10 to a belt (not shown) located around the waist of an individual. The strap 26 forms the bottom of the holster 16 and is sewn and attached to the frontal closure straps 20 at 30. Also shown is the CD bottom hook and loop mating material 33 and the sewing attachment 34 between the frontal strap 20 and the belt loop 22.

Figure 6:
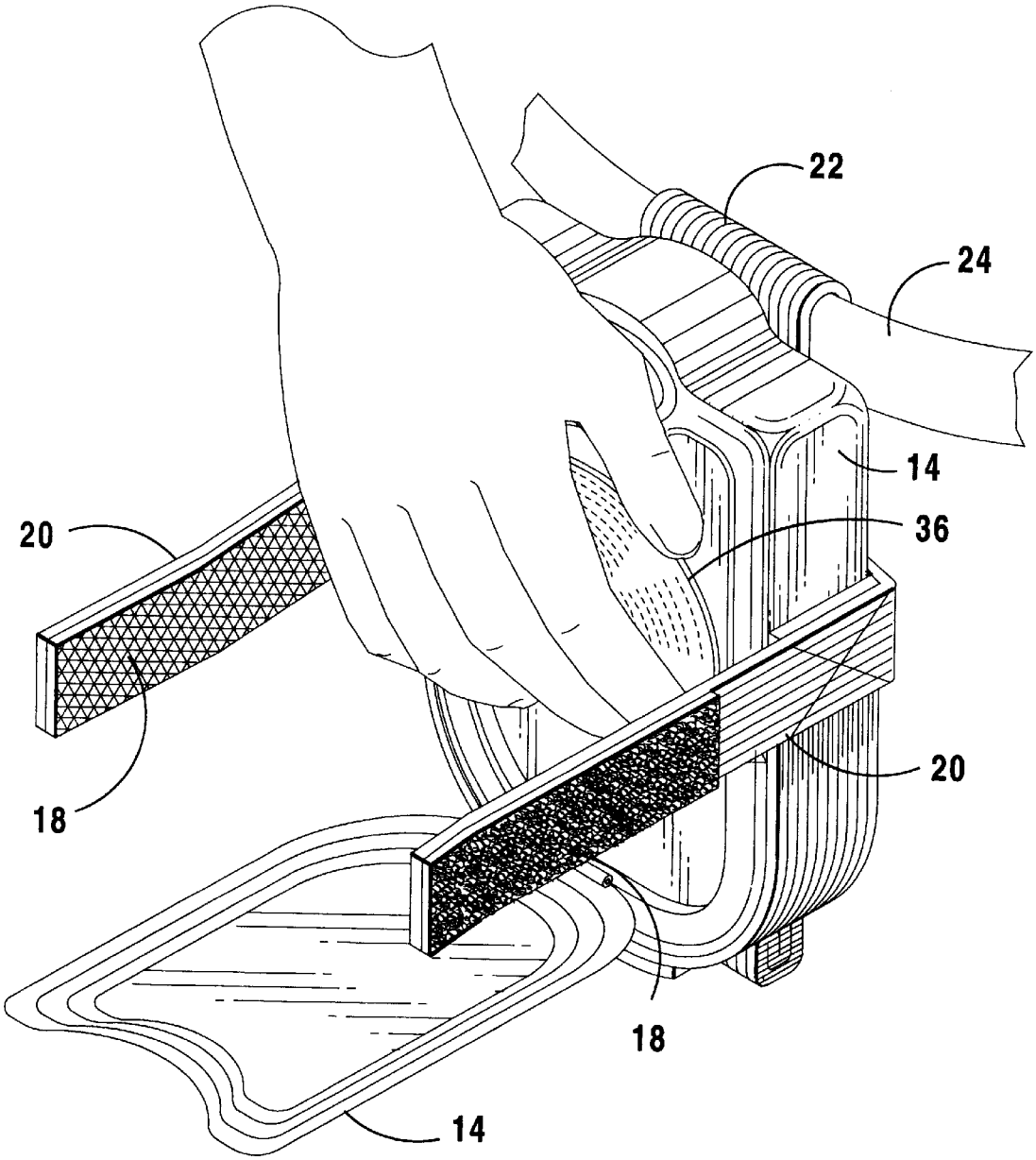
FIG. 6 is a perspective view of the present invention in use where the compact disc player is open and the compact disc is being changed.

Turning to FIG. 6, therein is shown a perspective view of the present invention in use where the compact disc player 14 is open and the compact disc 36 is being changed. Also shown is the front strap 20 and the loop 22 and belt 24.

Figure 7:
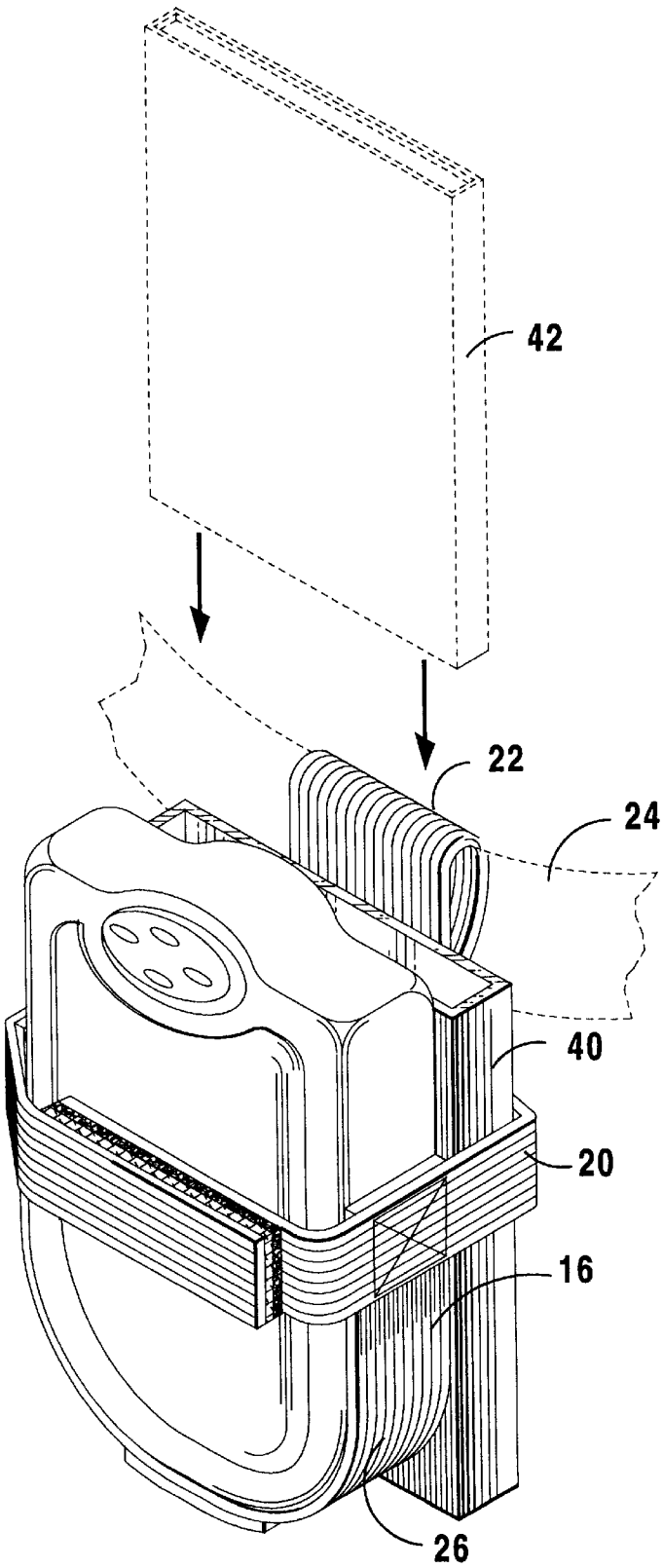
FIG. 7 is a perspective view of an alternate embodiment of the present invention wherein a compartment is provided for the storage of additional discs within a hard plastic carrying case shown in outline.

Turning to FIG. 7, therein is shown a perspective view of an alternate embodiment of the present invention wherein an upright compartment 40 having an opening on its top is provided for the storage of additional discs within a hard plastic carrying case 42 shown in outline. The compartment is sized to receive compact discs, is the approximate height and width of holster 16, and has its back positioned contiguous to the belt loop 22 so as to be between the belt loop 22 and the electronic device 14. Also shown is the front strap 20, the loop 22, belt 24, and bottom strap 26.

Figure 8:
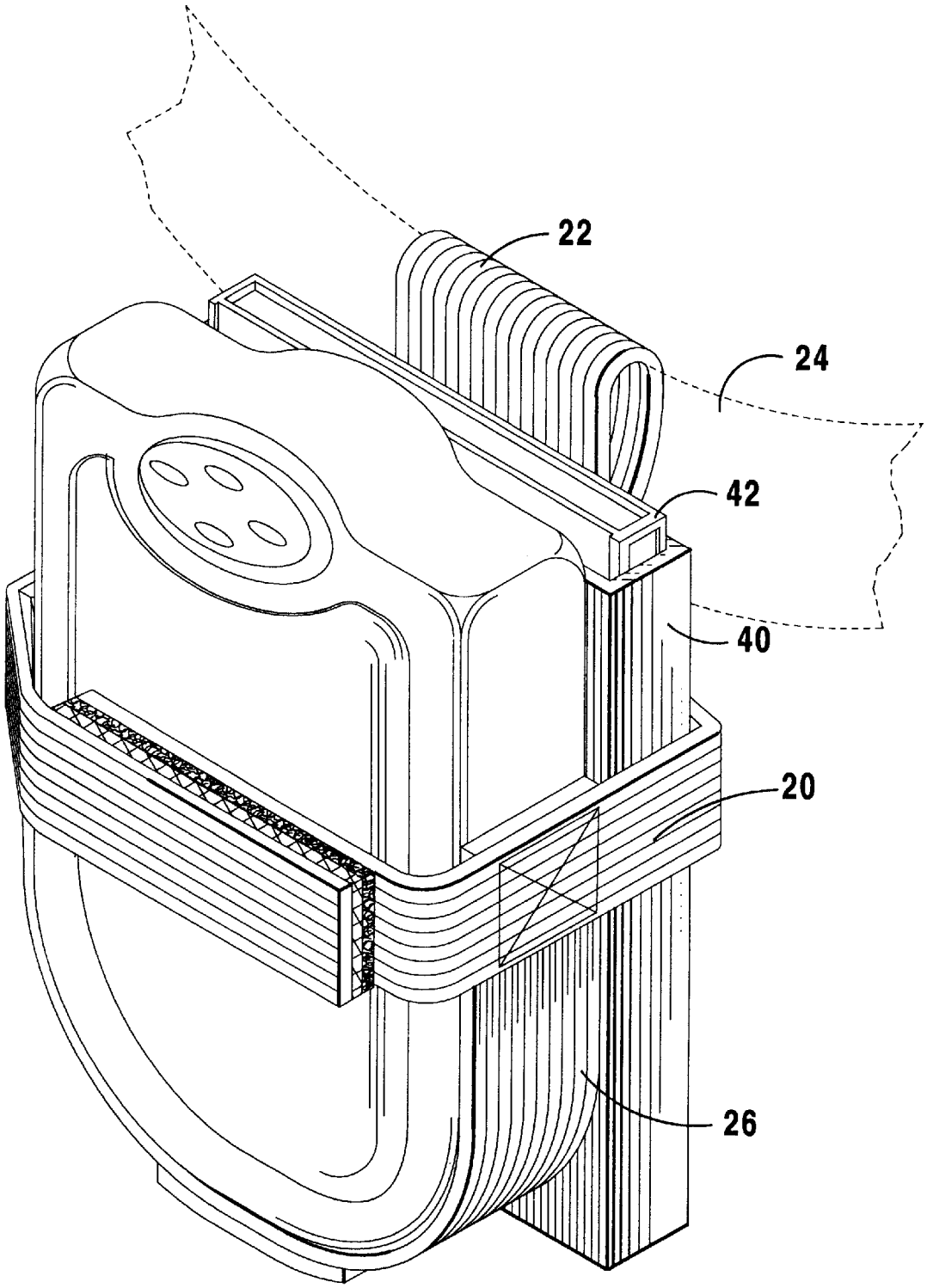
FIG. 8 is a perspective view of the alternate embodiment of the present invention. Shown are the additional discs positioned within the compartment of the compact disc player carrying case.

Turning to FIG. 8, shown therein is a perspective view of the alternate embodiment of the present invention. Shown are the additional discs in the case 42 positioned within the compartment 40 of the compact disc player carrying case 10. Also shown is the front strap 20, the loop 22, belt 24, and bottom strap 26.

Figure 9:
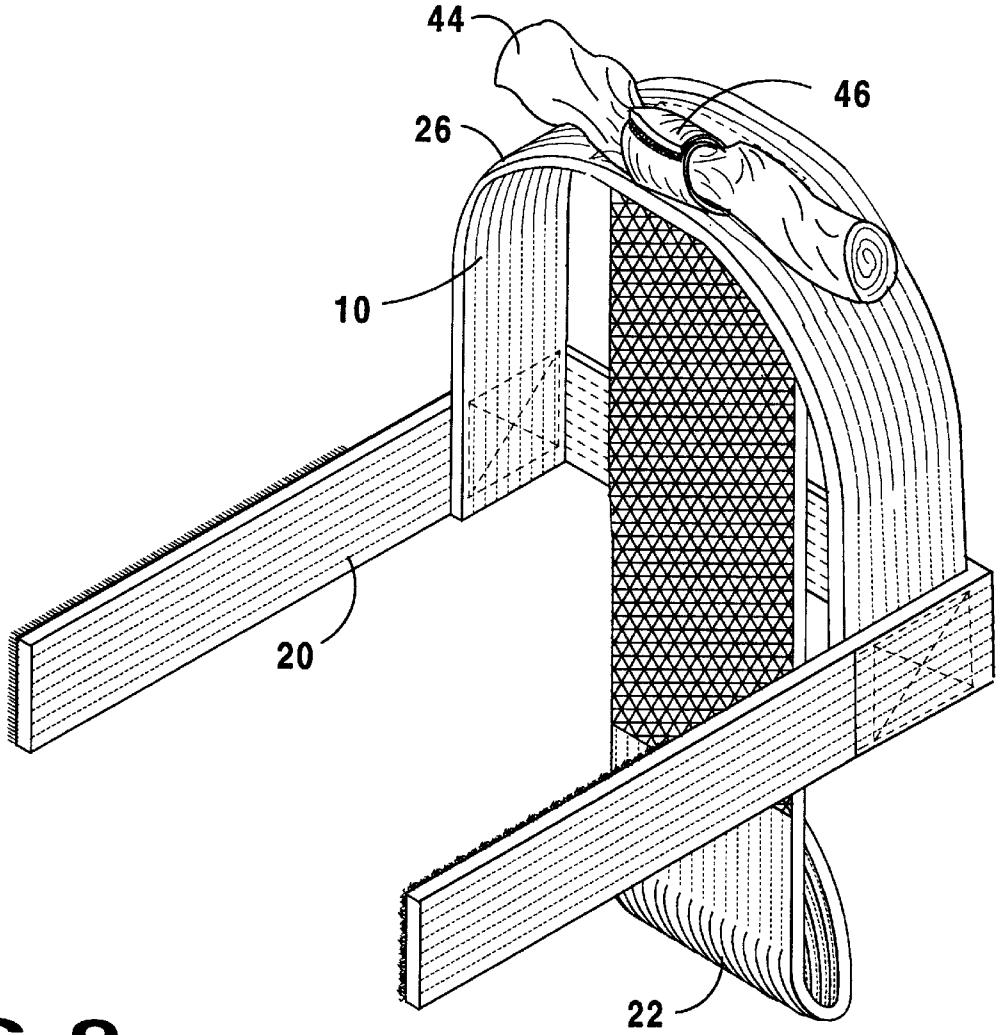
FIG. 9 is a bottom perspective view of an alternate embodiment of the present invention wherein a plastic hood having an elastomeric attachment member wherein said waterproof hood is unfolded and used to cover the compact disk player during inclement weather.

Turning to FIG. 9, shown therein is a bottom perspective view of an alternate embodiment of the present invention 10 wherein a plastic hood 44 having an elastomeric attachment member 46 attached to the bottom outside surface of the strap 26 wherein said waterproof hood can be unfolded from its normally folded position and used to cover the compact disk player (not shown) during inclement weather. Also shown is the front strap 20, the loop 22.

Figure 10:
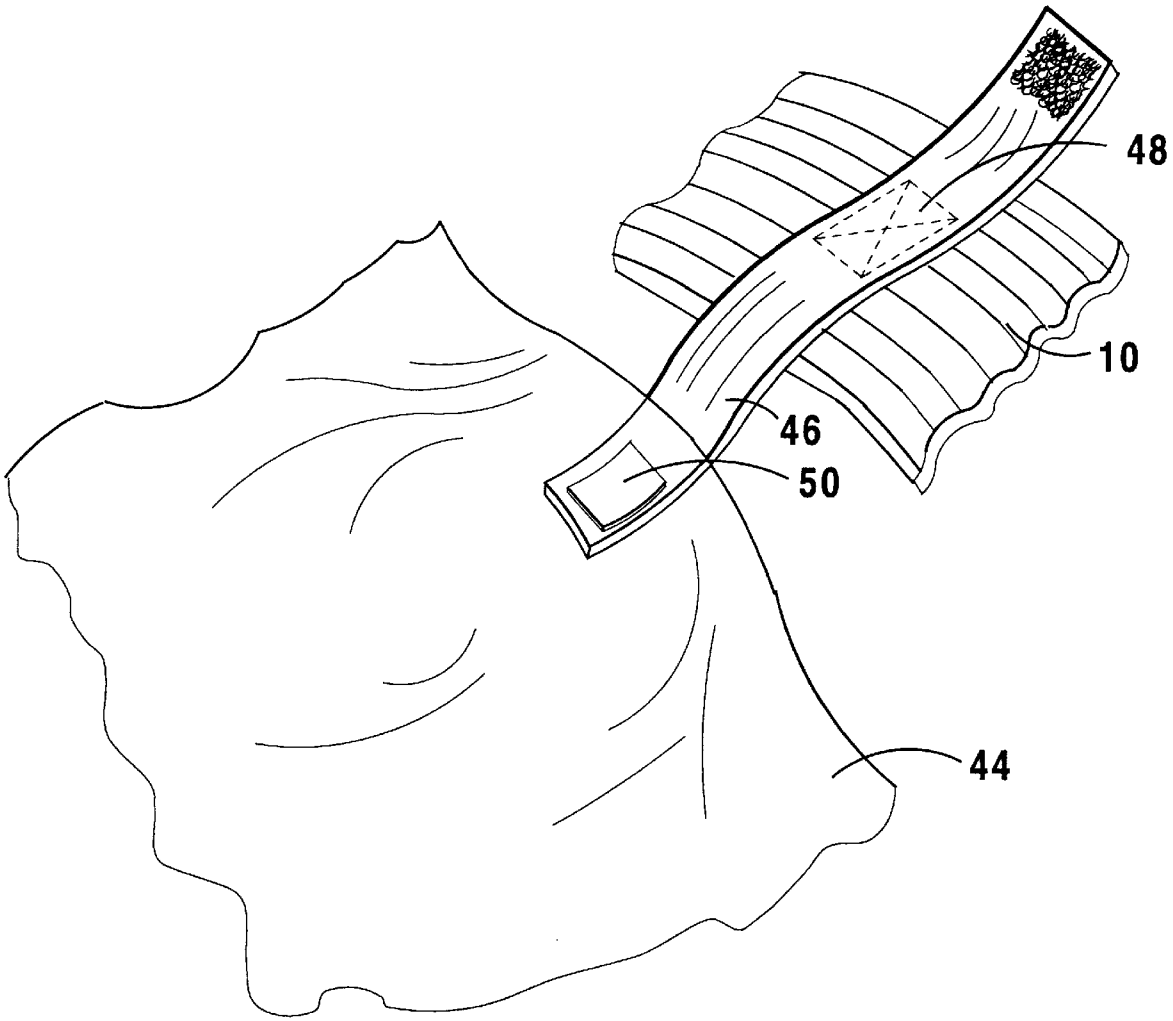
FIG. 10 is a perspective view of the elastomeric member in its extended state wherein it is attached to the compact disc player carrying case and the waterproof hood.

Turning to FIG. 10, shown therein is a perspective view of the elastomeric member 46 in its extended state wherein it is attached by means 48 to the compact disc player carrying case 10 at and by means 50 to the waterproof hood 44 which is made of a unitary piece of flexible waterproof material.

Figure 11:
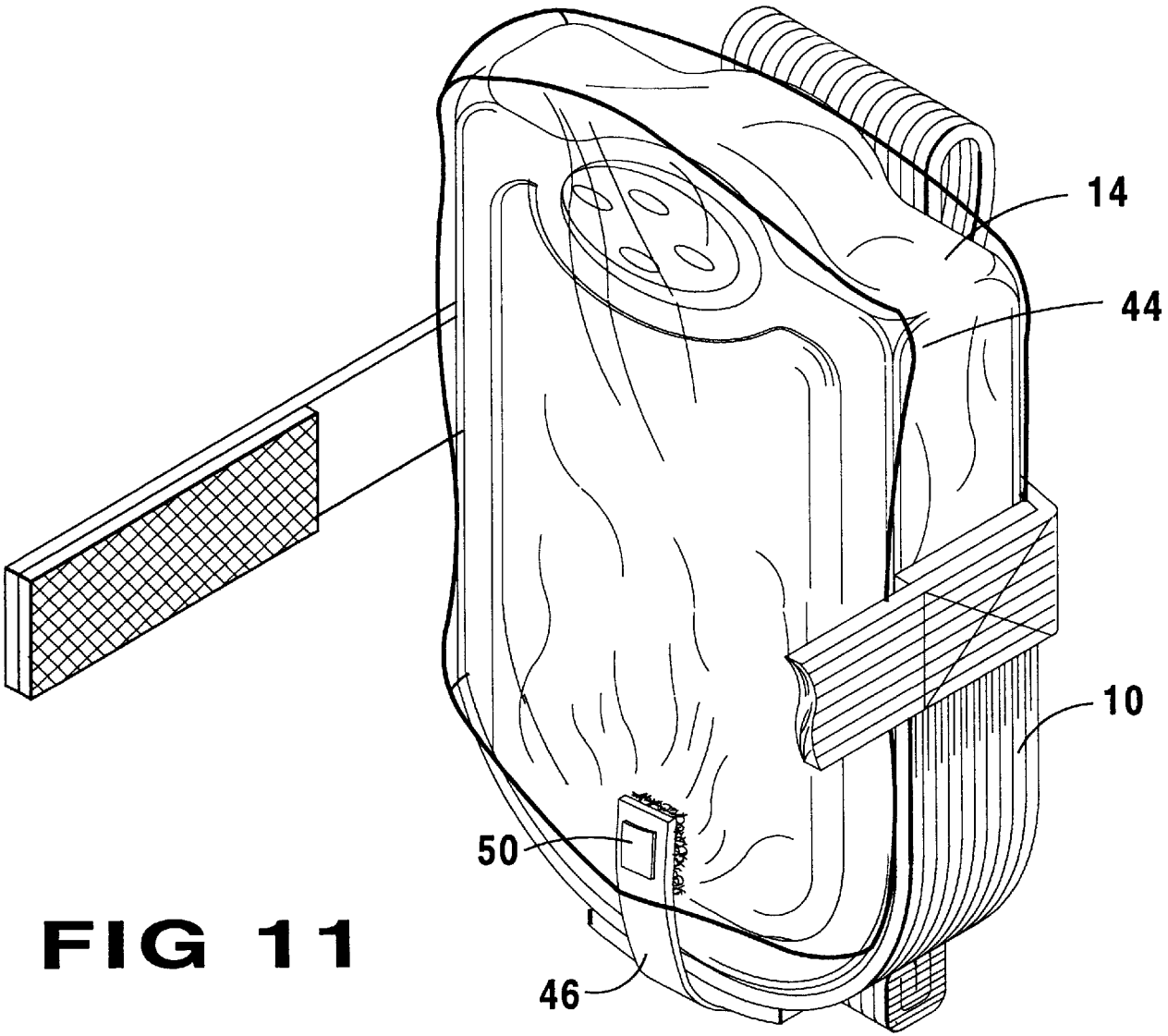
FIG. 11 is a perspective view of the compact disc carrying case wherein the plastic waterproof hood having been placed over the compact disc player by extending the elastomeric member will protect the compact disc player from inclement weather.

Turning to FIG. 11, shown therein is a perspective view of the compact disc carrying case 10 wherein the releasably secured plastic waterproof hood 44 having been placed over the compact disc player 14 by extending the elastomeric member 46 will protect the compact disc player 14 from inclement weather. The hood is located on the opposite end away from the elastomeric member 46 which member provides tensioning to the hood to hold it in place and the hood is sized to be extended over the electronic device 14.

It will be understood that each of the elements described above, or two or more together may also find a useful application in other types of apparatuses differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An apparatus for holding an electronic device comprising:

a) a first strap constructed generally in the horizontal plane, said first strap having means for releasably connecting its ends to each other for surrounding an electronic device;

b) a second strap extending substantially perpendicular to said first strap;

c) means for attaching said first strap and said second strap to each other to form a holster for receiving and electronic device with said second strap forming the bottom of the holstered;

d) a third strap constructed generally in the vertical plane, said third strap including means for attaching said third strap to said first and second straps; and a loop formed therein for receiving a belt whereby said holster is supported by said belt in a generally upright position and said electronic device is in a generally upright position; and e) a unitary piece of flexible waterproof material, said piece of flexible waterproof material being attached by elastomeric means on one of its ends to the bottom outside surface of said holster, having a hood on its opposite end, said hood being sized for extending over the top of said electronic device while said electronic device is contained in said holster, said unitary piece of flexible waterproof material being folded and releasably secured to the bottom outside of said holster by said elastomeric means, said elastomeric means tensioning said unitary piece of flexible waterproof material when said hood is extended over said electronic device whereby said hood forms a waterproof cover when extended over said electronic device.

2. The apparatus of claim 1, further comprising said connecting means for said first strap being hook and loop material.

3. The apparatus of claim 1, further comprising said attaching means for said first and said second straps being sewing means.

4. The apparatus of claim 1, further comprising said attaching means of said third strap to said first and second straps being sewing means.

5. The apparatus of claim 1, further comprising said third strap having a first strip of hook and loop material attached to its inner face being on the inside of said holster said first strip of hook and loop material for connecting to a second strip of hook and loop material attached to the back side of said electronic device whereby said electronic device is secured in said holster.

6. The apparatus of claim 1, further comprising said holster having an upright compartment having an opening on its top for receiving and sized for a compact disc being the height and width of said holster, said upright compartment having its back positioned contiguous to said third strap being between said electronic device and said third strap whereby a compact disc is stored.

* * * * *